US005657909A

United States Patent [19]

Barriac

[11] Patent Number: 5,657,909

[45] Date of Patent: Aug. 19, 1997

[54] MANUAL SPRAYER HAVING MULTI-DIRECTIONAL LIQUID PICKUP AND CONTAINER VENTING

[75] Inventor: Jacques J. Barriac, Claremont, Calif.

[73] Assignee: Calmar Inc., City of Industry, Calif.

[21] Appl. No.: 583,160

[22] Filed: Jan. 4, 1996

[51] Int. Cl.[6] ..... B67D 5/40

[52] U.S. Cl. ..... 222/382; 222/464.6

[58] Field of Search ..... 222/382, 464.3, 222/464.6, 383.1, 481.5

[56] References Cited

U.S. PATENT DOCUMENTS

| | | | |
|---|---|---|---|
| 660,669 | 3/1900 | Keller . | |
| 1,190,586 | 7/1916 | Robertson . | |
| 2,372,678 | 4/1945 | McKay . | |
| 2,986,310 | 5/1961 | Spaulding . | |
| 3,088,680 | 5/1963 | Fulton et al. . | |
| 3,211,349 | 10/1965 | Prussin et al. . | |
| 3,311,274 | 3/1967 | Green . | |
| 3,490,656 | 1/1970 | Taschner . | |
| 3,580,430 | 5/1971 | Angele . | |
| 4,186,882 | 2/1980 | Szczepanski . | |
| 4,273,272 | 6/1981 | Blanc . | |
| 4,722,463 | 2/1988 | Anderson . | |
| 4,747,523 | 5/1988 | Dobbs . | |
| 4,830,235 | 5/1989 | Miller . | |
| 4,940,152 | 7/1990 | Lin . | |
| 5,195,664 | 3/1993 | Rhea . | |
| 5,344,053 | 9/1994 | Foster et al. . | |
| 5,398,104 | 3/1995 | Arcaro | 222/464.6 X |
| B1 4,072,252 | 11/1985 | Steyns et al. . | |

*Primary Examiner*—Gregory L. Huson

*Attorney, Agent, or Firm*—Watson Cole Stevens Davis, P.L.L.C.

[57] ABSTRACT

A manually actuated pump sprayer has an unvalved vent port connected by a vent tube to a float buoyed on the liquid level within the container. A dip tube forming a liquid passage extends from a valve controlled inlet which leads into the pump chamber. A terminal end of the liquid passage defined by the dip tube is connected to the float for communicating that end with the liquid in the container, and a terminal end of the air passage defined by the vent tube is connected to the float for communicating the air passage terminal end with the head space in the container. The pressure within the head space is always maintained at atmospheric, and the sprayer is capable of being operated in any position without leakage. The tubes may formed as an integrally extruded double tube with air pockets formed along the length of the double tube to define the float. And, buoyant material forming the air passage may define the float.

10 Claims, 2 Drawing Sheets

MANUAL SPRAYER HAVING MULTI-DIRECTIONAL LIQUID PICKUP AND CONTAINER VENTING

BACKGROUND OF THE INVENTION

This invention relates generally to a trigger actuated pump sprayer, and more particularly to a combined liquid pick up end container vent arrangement permitting pump operation without leakage in any attitude of the pump sprayer. The container vent is unvalved and admits air into the container as required to replace the dispensed liquid to prevent hydraulic lock end container collapse in the presence of a sub-atmospheric pressure condition within the container. Likewise, when spraying a gas/vapor producing liquid product such as a chemical cleaner or the like producing a superatmospheric pressure, the container vent releases such super-atmospheric pressure from the container to thereby maintain an equilibrium pressure.

Known trigger actuated pump sprayers, exemplified by U.S. Pat. Nos. 4,747,523, 5,344,053 and 4,072,252, here wired container vent means operable during pumping for admitting air into the container through a container vent port to avoid a sub-atmospheric pressure condition in the container during dispensing. However, during operation of the trigger sprayer while inverted or tilted from upright, there is a tendency of product to leak out through the vent without the provision of additional valving.

Moreover, when any of these known trigger sprayers is mounted on a container of gas/vapor producing liquid product such as a cleaning chemical capable of generating an elevated pressure in the container, such internal pressure tends to exert undue pressure against the trigger lever via the vent port end vent passage which interferes with pump operation. And, the superatmospheric pressure condition in the container tends to expand the container sidewalls producing an undesirable condition.

U.S. Pat. Nos. 4,722,463 and 4,186,882 disclose the use of a float at the end of a vent tube for maintaining the air inlet always at a position above the surface of the liquid regardless of the orientation of the container.

Other U.S. Pat. Nos., such as 5,195,664, 4,830,235, 4,273,272, 3,580,430, and others, each provide for a weighted free end of a flexible dip tube to maintain the liquid inlet always in communication with the liquid irrespective of the attitude of the container when pumping.

SUMMARY OF THE INVENTION

It is an object of the present invention to provide a trigger sprayer having both a multi-directional liquid pick up and a multi-directional container vent permitting pump operation in all attitudes of the container mounted pump for both venting air into the container during a container sub-atmospheric pressure condition, and for releasing super-atmospheric pressure from the container as when spraying gas/vapor producing liquid products. Venting in both directions, depending on the type of liquid product to be sprayed, is effected without leakage and without the need for additional valving, in a simple and economical yet highly effective manner.

The pump sprayer according to the invention has an elongated pick-up passage connected to the valve controlled inlet leading to the pump chamber, and the pump body has a container vent port with means defining an elongated air passage connected thereto. A terminal end of the liquid passage is connected to a float for communicating that terminal end with the liquid in the container. And, a terminal end of the air passage is connected to the float for communicating the air passage terminal end with the head space in the container above the liquid level. The float provides a dual function of maintaining the terminal end of the vent passage above the liquid level and the terminal end of the liquid passage below the liquid level in all attitudes of the container during pump operation to permit both liquid pick up during the pumping suction strokes and venting of air into or out of the head space depending on the below-atmospheric or the above-atmospheric pressure condition within the container.

The liquid passage means and the air passage means may comprise separate flexible tubes, or may comprise an integrally extruded molded flexible double tube.

The float may comprise a body of buoyant synthetic material to which the terminal ends of the liquid and air pump means are connected. The terminal end of the air passage may be located at a distal end of the vent tube, while the terminal end of the liquid passage may be spaced from a distal end of the dip tube.

According to another embodiment, the float may comprise a plurality of buoyant air-filled tubular sections formed along the length of an integrally extruded double flexible tube defining parallel interconnected air passage and liquid passage means.

According to a further embodiment, the integrally molded flexible tube may comprise buoyant material defining the air passage and material having a specific gravity greater than that of the liquid for defining the liquid passage.

Other objects, advantages and novel features of the invention will become more apparent from the following detailed description of the invention when taken in conjunction with the accompanying drawings.

DETAILED DESCRIPTION OF THE INVENTION

Figure 1:
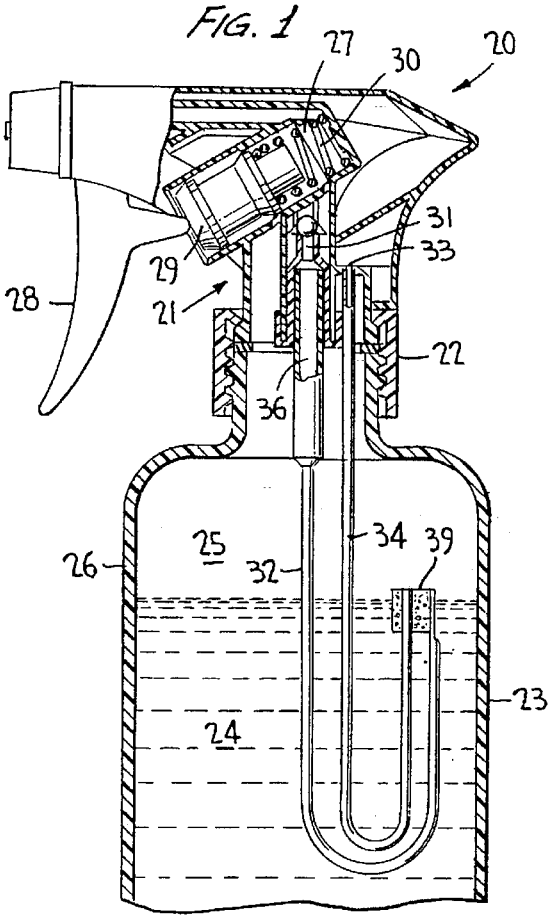
FIG. 1 is a vertical sectional view of a trigger actuated pump sprayer mounted on a liquid container shown in an upright position and incorporating the invention.
Figure 2:
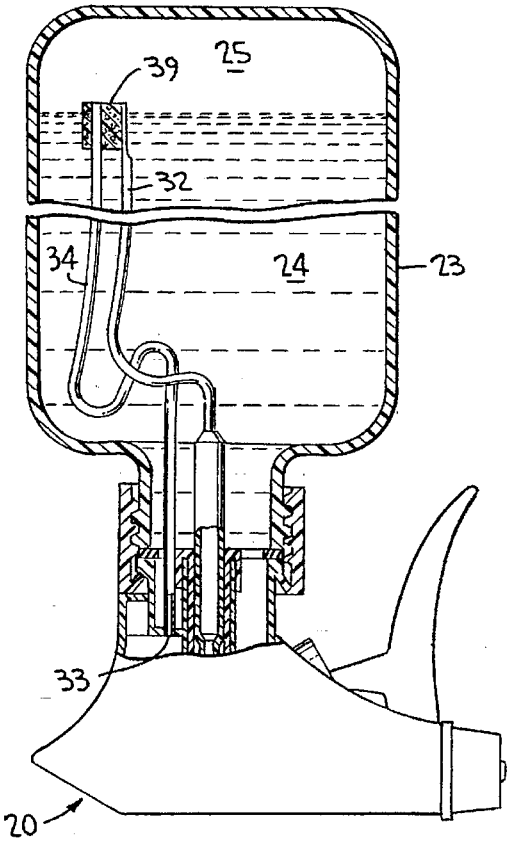
FIG. 2 is a view similar to FIG. 1 showing the pump mounted container in inverted position.
Figure 3:
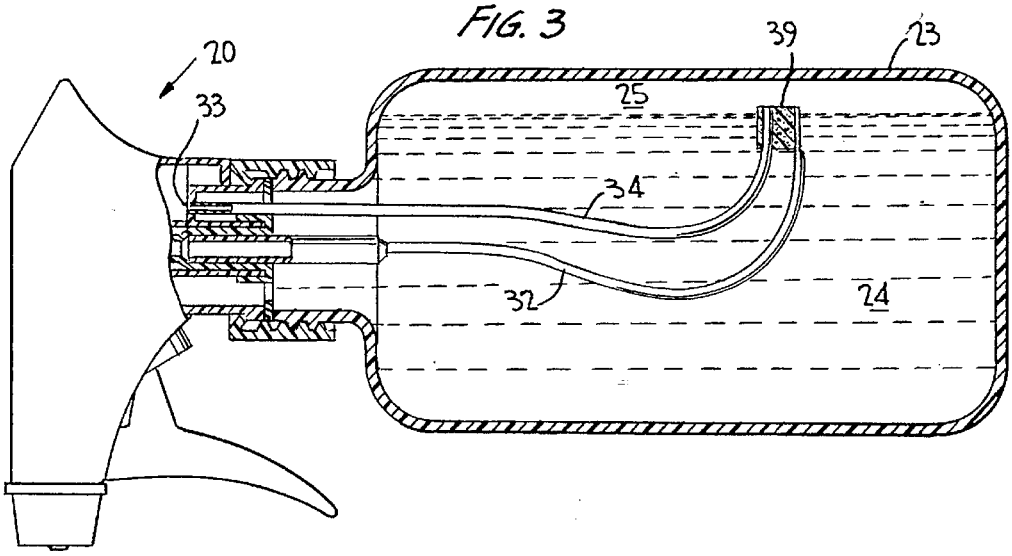
FIG. 3 is a view similar to FIG. 1 showing the pump mounted container in a lateral position.

Turning now to the drawings wherein like reference characters refer to like and corresponding parts throughout the several views, a trigger actuated pump sprayer, generally designated 20, is shown in FIGS. 1, 2 and 3 as having a pump body 21 and a container closure 22 coupled to the pump body for mounting the sprayer on a container 23 at least partially filled with a liquid 24 to be sprayed. As in most containers not completely filled with liquid product, a head space 25 is defined within the container above liquid level 26.

Trigger actuated pump sprayer 20 is similar to that shown in U.S. Pat. No. 4,747,523, commonly owned herewith, and operates in a similar manner after the pump chamber 27 is primed for dispensing liquid upon each pull of trigger 28 which reciprocates pump piston 29 against the force of piston return spring 30.

The pump body has a valve controlled product inlet passage 31 leading into the pump chamber, and a product pick-up tube, sometimes referred to as a dip tube 32, depending from the pump body in communication with the inlet and extending into the liquid 24 of the container.

Figure 4:
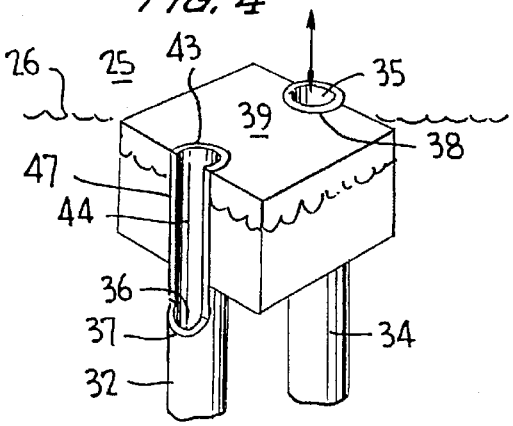
FIG. 4 is a detailed, perspective view of a molded float to which the terminal ends of the liquid and air passages are connected according to one embodiment of the invention.

Unlike the trigger sprayer according to the aforementioned '523 patent, which has a piston valve controlled container vent and in which no provision is made to facilitate inverted and tilted spray, the container vent port at the piston and the vent valve control thereof are eliminated according to the invention, and a container vent port 32, at a convenient location in the pump body, is always open to atmosphere. An elongated tube 34, which may be flexible and separate from tube 32, forms an air passage 35 (FIGS. 4, 5), and tube 32 forms a liquid passage 36.

According to the invention, terminal end 37 (FIG. 4) of liquid passage 36 is connected to a float 39 such that end 37 is always in communication with the liquid in the container, i.e., below liquid level 26. And, a terminal end 38 of air passage 35 is connected to float 39 such that end 38 is maintained in communication with head space 25 within the container.

Figure 5:
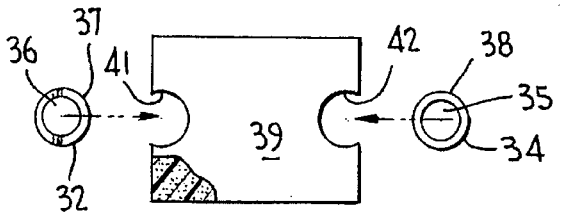
FIG. 5 is a top plan and expanded view of FIG. 4.

A simple manner of connecting tubes 32 and 34 to the float is illustrated in FIG. 5, in which opposing sides of the float are provided with cut outs 41, 42, such that tube 32 can be simply snapped into place within its cut out 41, and tube 34 can be snapped into place within its cut out 42. And, terminal end 38 of the vent passage is located at the distal end of the vent tube, which may be coplanar with the upper exposed surface of the float. However, terminal end 37 of liquid passage 36 is spaced at sufficient distance from distal end 43 of tube 32 such that terminal end 37 is maintained always below liquid level 26 while tube 32 is connected to the float. The spacing of ends 43 and 37 from one another can be simply effected by the provision of an elongated opening 44 as by the removal of a split end of tubing 32 to form an axial slot 47.

Referring to FIGS. 1, 2 and 3, tubes 32 and 34 drape within liquid 24 in the container and are each of a sufficient length to accommodate a lowering of float 39 as the contents of the container are gradually dispelled during pumping. In operation, the product is dispensed upon actuation of trigger lever 28, causing pump piston 29 to reciprocate within its pump cylinder against the force of its return spring 30, similar in all respects to that described in the aforementioned U.S. Pat. No. 4,747,523. During each return stroke of the piston, liquid product is suctioned into pump chamber 27 through liquid passage 36 and valved inlet passage 31 as terminal end 37 of the liquid passage remains below the liquid level 26 throughout pumping. As product is dispelled from the container during pump operation, head space 25 expands thereby creating a sub-atmospheric pressure condition. The head space is continually vented to atmosphere via open vent port 33, which remains in open communication with the head space through air passage 35, such that product suctioned from the container is replaced by air to prevent hydraulic lock and container collapse.

When spraying with the FIG. 1 dispensing package inverted as in FIG. 2 or when lying on its side as in FIG. 3, or in any other attitude of the dispensing package, float 39 follows the shifting level of liquid relative to head space 25 and maintains terminal/distal end 38 of air passage 35 in communication with the head space, and maintains terminal end 37 of liquid passage 36 below the liquid level, permitting pump operation in the same manner as described with reference to FIG. 1. Since vent port 33 remains in open communication with the head space, while the pump body is tightly sealed to the neck of the container with no other vent or other opening provided in the pump body, leakage of product through the vent port is avoided while pumping in attitudes of the pump of FIGS. 2 and 3 and in any other attitude. Likewise, should the dispensing package tip over into its FIG. 3 position, leakage of product is prevented as vent port 33 remains in open communication only with head space 25.

When liquid 24 comprises a formulation which may build-up pressure exceeding atmospheric, as a gas generated by a chemical cleaner or the like, that superatmospheric pressure tends to expand the walls of the plastic container outwardly unless vented to atmosphere. Such release of pressure from head space 25 is effected via open vent port 33 which remains in communication with the head space as described above.

Thus, depending on the nature of liquid 24, and regardless of the attitude of the dispensing package during pumping, the sub-atmospheric pressure developed in head space 25 is maintained at atmospheric, and the superatmospheric pressure in the head space generated by a chemical cleaner or the like is likewise maintained at atmospheric through the open vent port.

Figure 6:
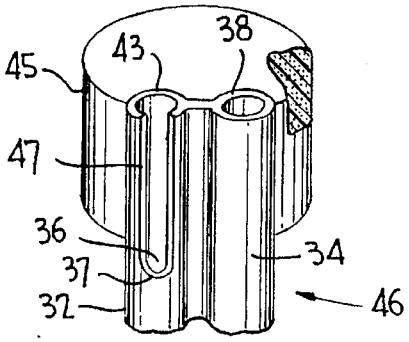
FIG. 6 is a detailed, perspective view of an integrally extruded flexible double tube forming the air and liquid passages connected to a molded float, according to another embodiment of the invention.

Other float structures may be devised without departing from the scope of the invention. For example, a cylindrical shaped float 45 may be provided as in FIG. 6, comprising a body of buoyant molded synthetic material having a specific gravity less than the liquid to be dispensed and tubes 32, 34 may comprise an integrally extruded flexible double tube 46 secured at its free end to float 45 either by some type of snap-fit engagement with a similarly shaped groove provided at the sidewall of the float, or by the use of an adhesive or the like. Otherwise, terminal end 38 of air passage 35 is, as in FIG. 4, arranged to be maintained in open communication with head space 25 as the float is buoyed at the liquid level. And, liquid tube 32 has terminal end 37 of its liquid passage 36 maintained below the liquid level as by the provision of an open axial slot 47 extending between distal end 43 of the liquid tube and terminal end 37. The double tube may be mounted to the pump body in communication with the valved inlet passage and the vent port, in some convenient manner forming no part of the invention.

Figure 7:
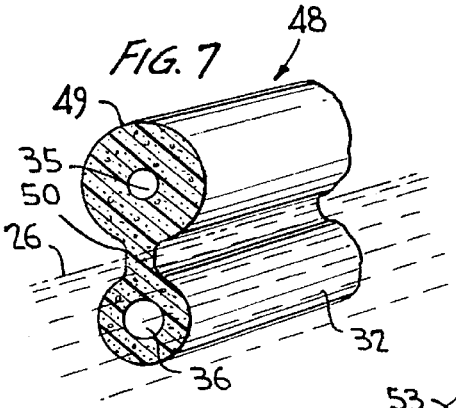

An integral double flexible tube 48 of the FIG. 7 embodiment includes a tubular elongated float 49 having a specific gravity less than the liquid to be dispensed, and defining air passage 35 which may be coaxial with the float. And, double tube 48 includes tube 32 having a specific gravity greater than that of the liquid to be dispensed. Float 49 may comprise a body of buoyant synthetic foamed material, and tube 32 is connected thereto as by an elongated web 50 which may comprise the same material as that of the tube.

Tube 32, being of a denser material compared to that of float 49, stabilizes and anchors the float at the liquid level insuring that air passage 35 remains above the liquid level and that liquid passage 36 remains below the liquid level.

Figure 8:
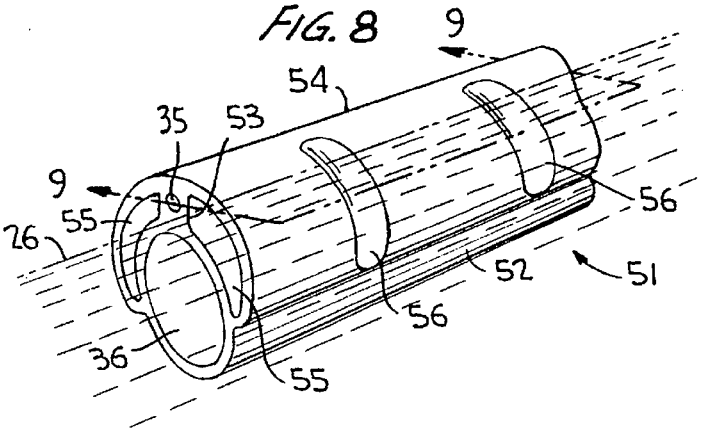
FIGS. 7 and 8 are perspective views of integrally extruded double flexible tubes having other integral float structures according to the invention.
Figure 9:
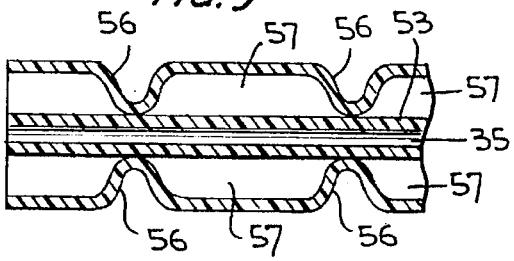
FIG. 9 is a sectional view taken substantially along the line 9—9 of FIG. 8.

An integrally extruded double flexible tube 51 of the FIG. 8 embodiment comprises an elongated tubular section 52 defining liquid passage 36, and an elongated rib 53 defining air passage 35. A crown wall 54 of arcuate shape extends from opposite sides of the rib in spaced relation to tubular section 52 to form hollow spaces 55. These hollow spaces are crimped closed by depressions 56 (FIG. 9) spaced along the length thereof to form air pockets 57. Depressions 56 may be formed by a plastic hot welding technique or the like.

The air pockets of this double tube arrangement stabilize and maintain the over-and-under relationship of the air and liquid passages maintaining terminal end 38 of the air passage in communication with the head space in the container and maintaining the distal end of the liquid passage below the liquid level.

Figure 10:
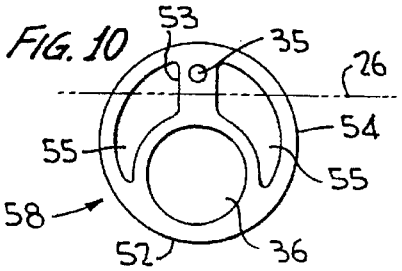
FIGS. 10, 11 and 12 are cross-sectional views of other embodiments of the FIG. 8 double tube with float structure according to the invention.
Figure 11:
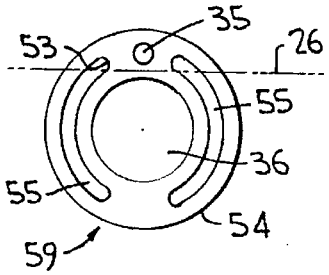
Figure 12:
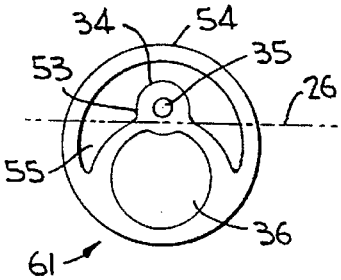

Other double tube float structures, similar to that of FIG. 8, are shown in FIGS. 10, 11, and 12. In FIG. 10, crown wall 54 of double tube 58 can be extruded as part of the major diameter of tubular section 52, forming hollow spaces 55. The crimping of wall 54 as at 56 along its length provides air pockets 57 (not shown) for buoying the double tube to maintain an over-and-under relationship of the air and liquid passages relative to liquid level 26.

Double tube 59 of the FIG. 11 embodiment has its liquid passage 36 formed concentric with crown wall 54 forming arcuate side spaces 55. The crimping of the crown wall as at 56 along its length forms air pockets 57 for buoying the double tube upright, and for maintaining the over-and-under relationship of the air and liquid passages relative to the level of liquid in the container.

Double tube 61 of the FIG. 12 embodiment has its crown wall spaced above vent tube 34 to form a single hollow space 55. The crimping of the crown wall as at 56 along its length forms air pockets 57, as in the FIGS. 8, 10 and 11 embodiments, to maintain the over-and-under relationship of the air and liquid passages relative to the liquid level, as shown.

From the foregoing, it can be seen that the sprayer according to the invention can be operated upright, inverted, and tilted in any direction without leakage, while maintaining the head space within the container at atmospheric pressure, by utilizing a float to which both the air and liquid tubes are connected. The terminal ends of the air and liquid passages are respectively maintained above and below the level of liquid in the container by the provision of float structures which may take various shapes and forms without departing from the invention.

And, although the invention has been described with reference to a trigger sprayer, the multidirectional liquid pickup and container venting arrangement of the invention is adaptable for use with fingertip actuated sprayers and dispensers, so long as the float readily self levels in the liquid to be dispensed.

Obviously, many other modifications and variations of the present invention are made possible in the light of the above teachings. It is therefore to be understood that within the scope of the appended claims the invention may be practiced otherwise than as specifically described.

What is claimed is:

1. A manually actuated pump sprayer having a pump body and closure means coupled to said body for mounting the sprayer on a container at least partially filled with a liquid to be sprayed, the container defining a head space above the liquid level, said pump body having a valve controlled inlet leading to a variable volume pump chamber, means defining an elongated liquid pick-up passage connected to said inlet, said pump body having an unvalved container vent port, and means defining an elongated air passage connected to said vent port, at least a terminal end of said liquid passage being connected to a float for communicating said terminal end with the liquid in the container, and at least a terminal end of said air passage being connected to said float for communicating said air passage terminal end with said head space.

2. The pump sprayer according to claim 1, wherein said liquid pick-up passage means comprises a flexible dip tube, and said air passage means comprises a flexible container vent tube.

3. The pump sprayer according to claim 1, wherein an integrally extruded flexible double tube defines said liquid passage means and said air passage means.

4. The pump sprayer according to claim 1, wherein said float comprises a body of buoyant synthetic material.

5. The pump sprayer according to claim 2, wherein said terminal end of said air passage is located at a distal end of said vent tube, and said terminal end of said liquid passage is spaced from a distal end of said dip tube.

6. The pump sprayer according to claim 3, wherein said terminal end of said air passage is located at a distal end of said double tube, and said terminal end of said liquid passage said spaced from said distal end.

7. The pump sprayer according to claim 1, wherein said float comprises a body of buoyant synthetic material having a specific gravity of less than that of the liquid, said air passage extending through said float, and a second body of synthetic material connected to said float, said second body having a specific gravity of greater than that of the liquid, and said liquid passage extending through said second body.

8. The pump sprayer according to claim 3, wherein means connected to said double tube defines a plurality of air pockets extending therealong, said air pockets defining said float.

9. The pump sprayer according to claim 8, wherein said means connected to said double tube comprises a crown wall extending along the length and spaced from said double tube.

10. The pump sprayer according to claim 9, wherein said crown wall is crimped along the length thereof to form said air pockets.

* * * * *